US011236526B2

(12) United States Patent
Shetty et al.

(10) Patent No.: US 11,236,526 B2
(45) Date of Patent: Feb. 1, 2022

(54) PUSHBUTTON MECHANISMS FOR LOCKSETS

(71) Applicant: Schlage Lock Company LLC, Carmel, IN (US)

(72) Inventors: Adithya Gangadhar Shetty, Bangalore (IN); Subashchandra G. Rai, Bangalore (IN); Hassan Charan Kumar, Bangalore (IN); Madhu Hulikere Siddaramaiah, Mandya District (IN); Ravi Teja Naga Satya Tadepalli, Bangalore (IN)

(73) Assignee: Schlage Lock Company LLC, Carmel, IN (US)

( * ) Notice: Subject to any disclaimer, the term of this patent is extended or adjusted under 35 U.S.C. 154(b) by 124 days.

(21) Appl. No.: 16/713,238

(22) Filed: Dec. 13, 2019

(65) Prior Publication Data

US 2021/0180365 A1 Jun. 17, 2021

(51) Int. Cl.
*E05B 55/00* (2006.01)
*E05B 1/00* (2006.01)
*E05B 63/00* (2006.01)

(52) U.S. Cl.
CPC ..... *E05B 55/005* (2013.01); *E05B 1/0038* (2013.01); *E05B 63/0056* (2013.01)

(58) Field of Classification Search
CPC ..... E05B 55/00; E05B 55/005; E05B 1/00; E05B 1/0038; E05B 1/046; E05B 13/00; E05B 13/002; E05B 13/10; E05B 13/105; E05B 13/103; E05B 47/0657; E05B 63/00; E05B 63/0056
USPC ..... 70/224
See application file for complete search history.

(56) References Cited

U.S. PATENT DOCUMENTS 2,743,123 A * 4/1956 Alexander ..... E05C 1/163 292/1
4,345,449 A 8/1982 Mullich
5,460,417 A * 10/1995 Zuckerman ..... E05B 13/106 292/175
5,584,515 A 12/1996 Silye
(Continued)

OTHER PUBLICATIONS

International Search Report; International Searching Authority; International Patent Application No. PCT/US2020/064886; dated May 26, 2021; 2 pages.
(Continued)

*Primary Examiner* — Nathan Cumar
(74) *Attorney, Agent, or Firm* — Taft Stettinius & Hollister LLP

(57) ABSTRACT

An exemplary pushbutton mechanism is configured for use with a lockset including a spindle and a plunger extending into the spindle, and generally includes a first component, a second component, and a cam interface. The first component is configured for rotational coupling with the plunger and for axial coupling with the spindle, and is rotatable between a locking orientation and an unlocking orientation. The second component is configured for rotational coupling with the spindle and for axial movement relative to the first component and the spindle, and is axially movable between a depressed position and a projected position. The cam interface is configured to correlate rotation of the first component with axial displacement of the second component.

22 Claims, 13 Drawing Sheets

(56) References Cited

U.S. PATENT DOCUMENTS

| | | | | |
|---|---|---|---|---|
| 5,941,108 | A * | 8/1999 | Shen | E05B 55/005 70/467 |
| 6,178,789 | B1 | 1/2001 | Finkelstein et al. | |
| 6,497,126 | B2 | 12/2002 | Wang | |
| 6,615,630 | B2 | 9/2003 | Wu et al. | |
| 6,623,053 | B1 | 9/2003 | Hwang | |
| 6,860,529 | B2 * | 3/2005 | Chong | E05B 13/002 292/169.18 |
| 7,377,143 | B2 | 5/2008 | Wang | |
| 8,084,701 | B1 | 12/2011 | Misner | |
| 8,505,345 | B2 | 8/2013 | Sun et al. | |
| 9,115,509 | B2 | 8/2015 | Huang et al. | |
| 9,121,200 | B2 | 9/2015 | Weathersby | |
| 9,371,671 | B2 | 6/2016 | Weathersby | |
| 9,556,644 | B2 | 1/2017 | Yoon et al. | |
| 9,611,672 | B2 * | 4/2017 | Murphy | E05B 13/004 |
| 9,945,152 | B2 | 4/2018 | Huang et al. | |
| 10,753,121 | B2 | 8/2020 | Morse et al. | |
| 2002/0116965 | A1 * | 8/2002 | Bates | E05B 55/005 70/224 |
| 2003/0107223 | A1 | 6/2003 | Chong et al. | |
| 2009/0056391 | A1 | 3/2009 | Mathachan | |
| 2018/0073271 | A1 * | 3/2018 | Romero | E05B 15/0033 |
| 2019/0234108 | A1 | 8/2019 | Li | |

OTHER PUBLICATIONS

Written Opinion of the International Searching Authority; International Searching Authority; International Patent Application No. PCT/US2020/064886; dated May 26, 2021; 9 pages.

* cited by examiner

PUSHBUTTON MECHANISMS FOR LOCKSETS

TECHNICAL FIELD

The present disclosure generally relates to pushbutton mechanisms for locksets, and more particularly but not exclusively relates to modular pushbuttons capable of use in retrofit kits for existing locksets.

BACKGROUND

In certain existing locksets, the inside handle includes a turnpiece (e.g., a thumbturn) that is rotatable to transition the lockset between a locked state and an unlocked state. In other locksets, the inside handle includes a pushbutton, depression of which transitions the lockset from the unlocked state to the locked state. Due to the different actuating inputs (i.e., rotation vs. depression), turnpiece locksets and pushbutton locksets typically require different lock mechanisms. However, it may be desirable to provide the two formats with a common lock mechanism, for example to facilitate manufacture of both formats. Additionally, it may be desirable to convert an existing thumbturn-style lockset into a pushbutton lockset, for example in the event that the end user's preferences have changed since the time the turnpiece format lockset was installed. For these reasons among others, there remains a need for further improvements in this technological field.

SUMMARY

An exemplary pushbutton mechanism is configured for use with a lockset including a spindle and a plunger extending into the spindle, and generally includes a first component, a second component, and a cam interface. The first component is configured for rotational coupling with the plunger and for axial coupling with the spindle, and is rotatable between a locking orientation and an unlocking orientation. The second component is configured for rotational coupling with the spindle and for axial movement relative to the first component and the spindle, and is axially movable between a depressed position and a projected position. The cam interface is configured to correlate rotation of the first component with axial displacement of the second component. Further embodiments, forms, features, and aspects of the present application shall become apparent from the description and figures provided herewith.

DETAILED DESCRIPTION OF ILLUSTRATIVE EMBODIMENTS

Figure 1:
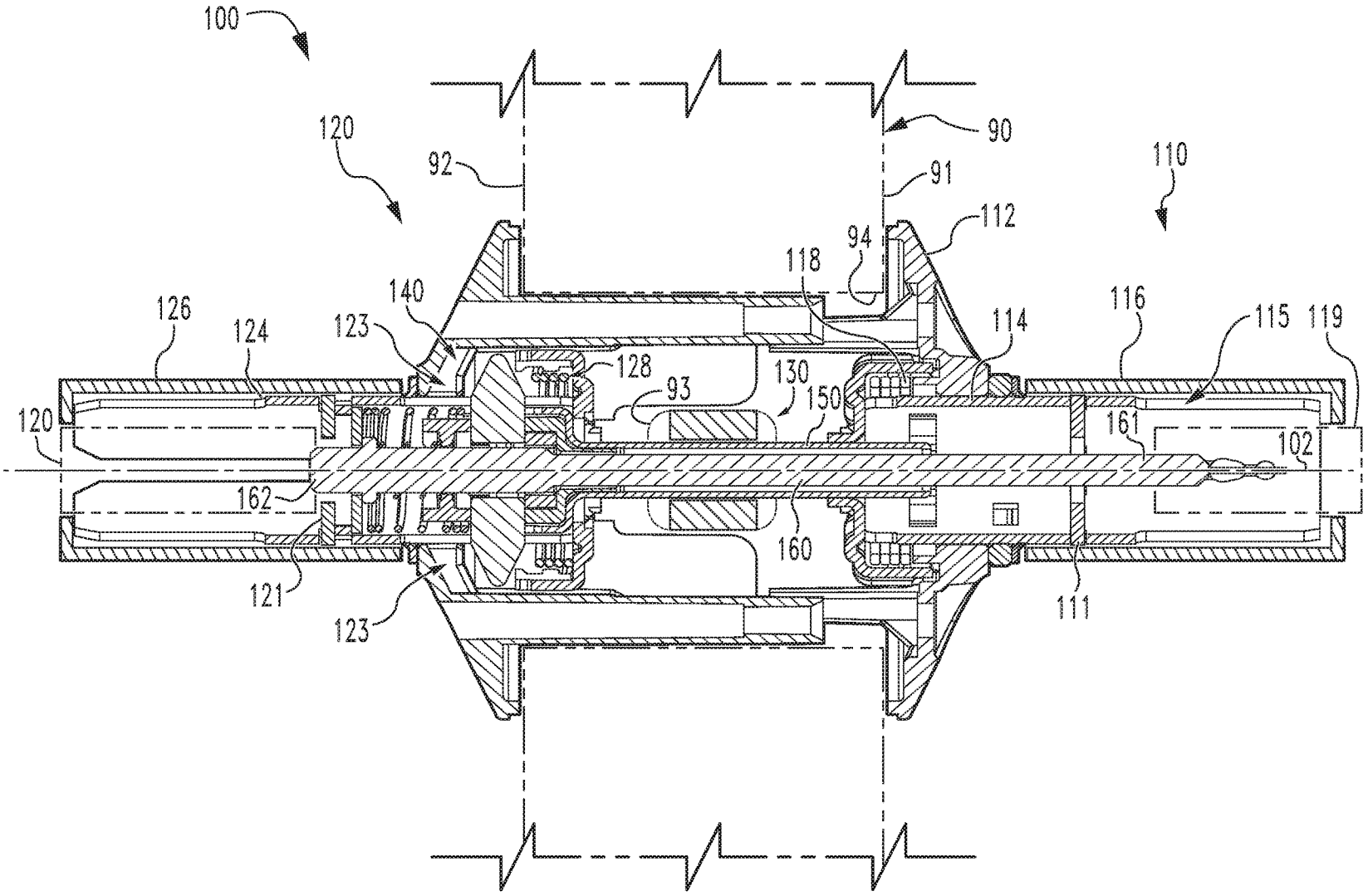
FIG. 1 is a cross-sectional illustration of a lockset according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

As used herein, the terms "longitudinal," "lateral," and "transverse" are used to denote motion or spacing along three mutually perpendicular axes. These terms are used for ease and convenience of description, and are without regard to the orientation of the system with respect to the environment. For example, descriptions that reference a longitudinal direction may be equally applicable to a vertical direction, a horizontal direction, or an off-axis orientation with respect to the environment. Furthermore, motion or spacing along a direction defined by one of the axes need not preclude motion or spacing along a direction defined by another of the axes. For example, elements that are described as being "laterally offset" from one another may also be offset in the longitudinal and/or transverse directions, or may be aligned in the longitudinal and/or transverse directions. The terms are therefore not to be construed as limiting the scope of the subject matter described herein to any particular arrangement unless specified to the contrary.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Items listed in the form of "A, B, and/or C" can also mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not necessarily be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may be omitted or may be combined with other features.

With reference to FIG. 1, illustrated therein is a lockset 100 according to certain embodiments installed to a door 90. The door 90 has an interior side or egress side 91, an exterior side or non-egress side 92, a latch bore 93 extending laterally inward from a free edge of the door 90, and a cross-bore 94 that extends between the egress side 91 and the non-egress side 92 and intersects the latch bore 93.

The lockset 100 generally includes an inside assembly 110 configured for mounting to the egress side 91 of the door 90, an outside assembly 120 configured for mounting to the non-egress side 92 of the door 90, a latchbolt mechanism 130 configured for mounting in the latch bore 93, and a lock 140 configured to selectively prevent a handle 126 of the outside assembly 120 from actuating the latchbolt mechanism 130. The lockset 100 further includes a center spindle 150 engaged with the latchbolt mechanism 130, and a plunger 160 rotatably mounted in the center spindle 150. Each of the center spindle 150 and the plunger 160 extends along a longitudinal axis 102 of the lockset 100. As described herein, rotation of the center spindle 150 actuates the latchbolt mechanism 130, and rotation of the plunger 160 transitions the lock 140 between a locked state and an unlocked state.

The inside assembly 110 generally includes an inside housing 112, an inside spindle 114 rotatably mounted to the housing 112, an inside handle 116 rotationally coupled with the inside spindle 114, an inside spring cage 118 biasing the spindle 114 and the handle 116 toward a home position, and an inside lock input device 119 mounted in the spindle 114 and engaged with the plunger 160. The inside spindle 114 is engaged with the center spindle 150 such that the inside handle 116 is operable to rotate the center spindle 150 to actuate the latchbolt mechanism 130, and includes a longitudinal slot 115. In certain forms, the inside handle 116 may be provided in the form of a lever handle, while in other embodiments, the inside handle 116 may be provided in the form of a knob handle. The inside assembly 110 may further include a retainer plate 111 that axially couples the inside handle 116 with the inside spindle 114.

The outside assembly 120 generally includes an outside housing 122, an outside spindle 124 rotatably mounted to the housing 122, an outside handle 126 rotationally coupled with the outside spindle 124, an outside spring cage 128 biasing the spindle 124 and the handle 126 toward a home position, and an outside lock input device 129 mounted in the handle 126 and engaged with the plunger 160. The outside spindle 124 is engaged with the center spindle 150 via the lock 140 such that the outside handle 126 is selectively operable to rotate the center spindle 150 to actuate the latchbolt mechanism 130. In certain forms, the outside handle 126 may be provided in the form of a lever handle, while in other embodiments, the outside handle 126 may be provided in the form of a knob handle. The outside assembly 120 may further include a retainer plate 121 that axially couples the outside handle 126 with the outside spindle 124.

Figure 2:
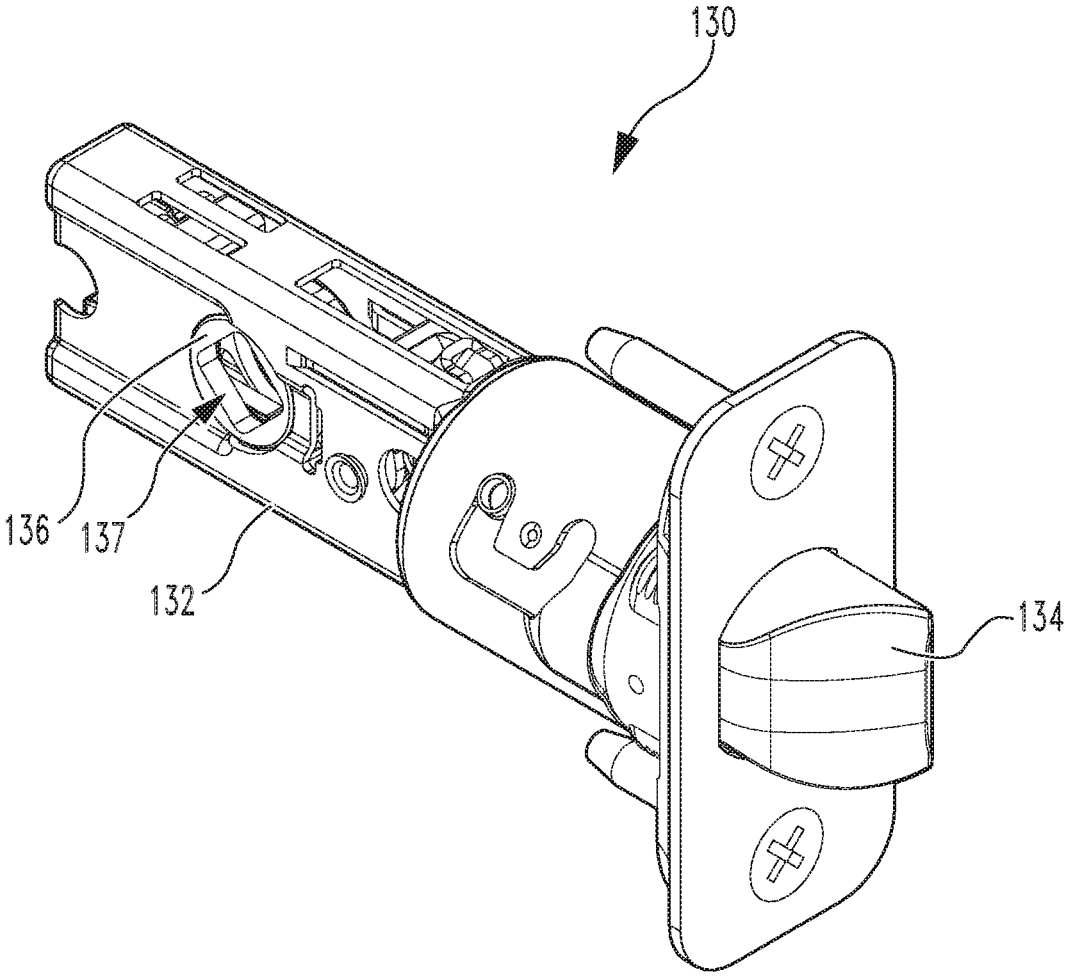
FIG. 2 is a perspective view of a latchbolt mechanism that may be utilized in certain embodiments.

With additional reference to FIG. 2, the latchbolt mechanism 130 is configured for mounting in the latch bore 93, and generally includes a housing 132, a latchbolt 134 movably mounted in the housing 132 for movement between an extended position and a retracted position, and a retractor 136 rotatably mounted in the housing 132 and engaged with the latchbolt 134 such that rotation of the retractor 136 drives the latchbolt 134 from its extended position to its retracted position. When the door 90 is in its closed position and the latchbolt 134 is extended, the latchbolt mechanism 130 aids in retaining the door 90 in its closed position. When the latchbolt 134 is driven to its retracted position (e.g., by rotation of the retractor 136), the door 90 becomes free to move to its open position. The latchbolt 134 may be biased toward its extended position, and the retractor 136 includes an opening 137 having a non-circular cross-section. As described herein, a stem 154 of the center spindle 150 extends through the retractor 136 such that the latchbolt mechanism 130 retracts the latchbolt 134 in response to rotation of the center spindle 150.

Figure 3:
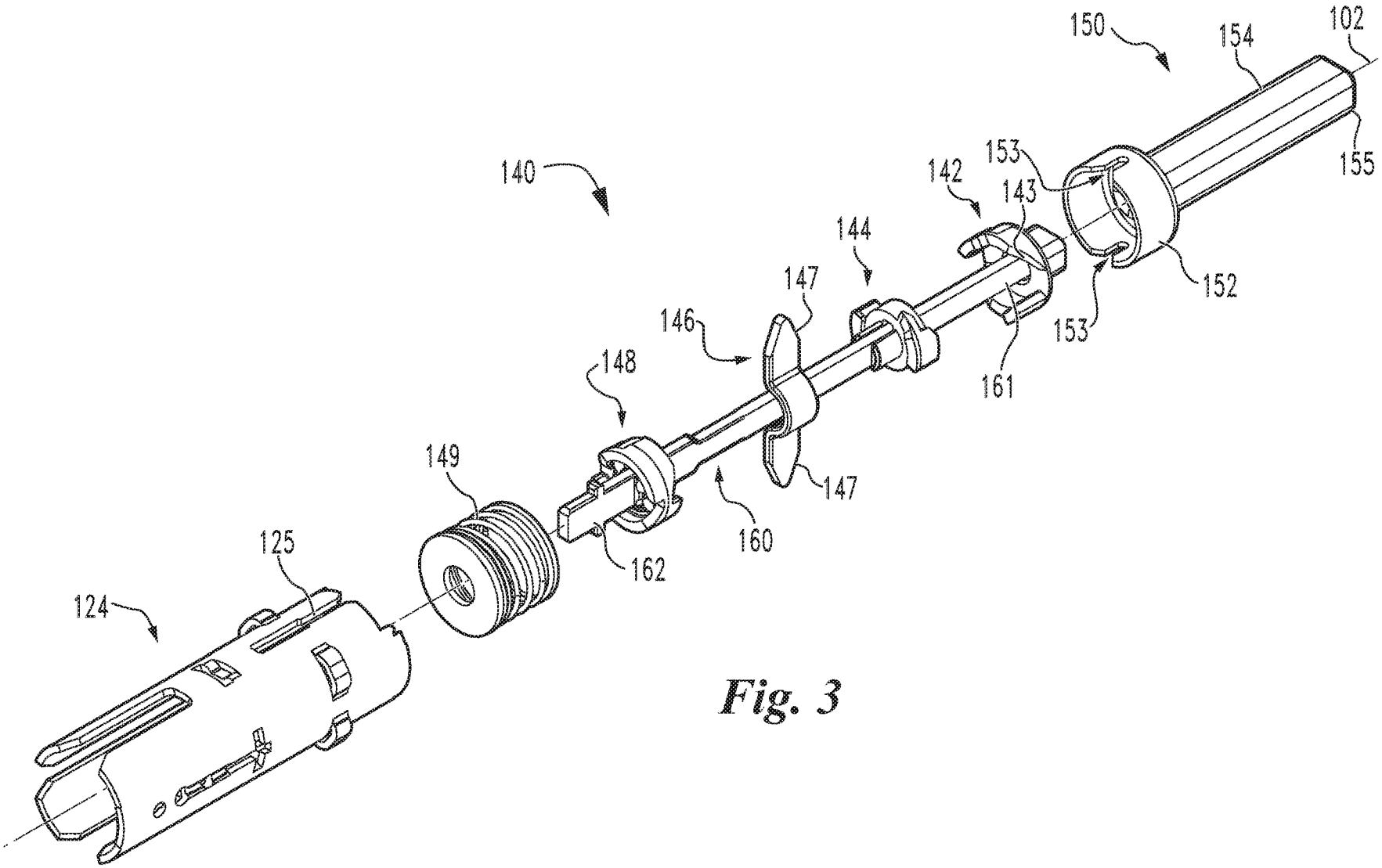
FIG. 3 is an exploded assembly view of a portion of the lockset illustrated in FIG. 1.

With additional reference to FIG. 3, the lock 140 generally includes a cam 142 rotationally coupled with the center spindle 150, a cam follower 144 rotationally coupled with the plunger 160, a longitudinally movable locking bar 146, a detent cam 148 engaged with the locking bar 146, and a spring 149 biasing the locking bar 146 toward an unlocking position. The cam 142 includes a ramp 143, and the follower 144 is slidably engaged and rotationally coupled with the plunger 160. The locking bar 146 is longitudinally movable between a locking position and an unlocking position, and includes a pair of arms 147 that extend radially outward through slots 125 in the outside spindle 124. As described herein, rotation of the plunger 160 relative to the center spindle 150 moves the lock 140 between a locking state and an unlocking state. During such movement of the lock 140 between the locking state and the unlocking state, the locking bar 146 moves longitudinally between a locking position and an unlocking position, and the plunger 160 rotates between a locking orientation and an unlocking orientation.

When the locking bar 146 is in its locking position, the arms 147 extend into recesses 123 formed in the outside housing 122 via the slots 125 in the outside spindle 124, thereby rotationally coupling the outside spindle 124 with the outside housing 122. As a result, the outside handle 126 is locked stationary, and is inoperable to actuate the latchbolt mechanism 130. When the locking bar 146 is in its unlocking position, the arms 147 are removed from the recesses 123 and engage notches 153 of the center spindle 150, thereby rotationally coupling the outside spindle 124 with the center spindle 150. As a result, the outside handle 126 is able to rotate the center spindle 150 to actuate the latchbolt mechanism 130.

In certain embodiments, the lock 140 and/or other certain other components of the lockset 100 may be of the type described in U.S. Pat. No. 9,611,672 to Murphy, the contents of which are incorporated by reference in their entirety. As described in that document, the inside handle 116 is operable to rotate the center spindle 150 to actuate the latchbolt mechanism 130 even when the lock 140 is in the locked state, and such rotation of the center spindle 150 by the inside handle 116 returns the lock 140 to its unlocked state.

The center spindle 150 extends along the longitudinal axis 102, and generally includes a cup 152 and a stem 154 extending from the cup 152. The cup 152 includes a pair of notches 153 operable to receive the arms 147 when the locking bar 146 is in its unlocking position such that the locking bar 146 selectively rotationally couples the outside spindle 124 with the center spindle 150. As noted above, the stem 154 extends through the retractor 136 such that rotation of the center spindle 150 actuates the latchbolt mechanism 130. An end portion 155 of the stem 154 is engaged with the inside spindle 114 such that the inside handle 116 is at all times capable of actuating the latchbolt mechanism 130, thereby providing free egress. As noted above, when the lock 140 is in its locking state, such rotation of the inside handle 116 also transitions the lock 140 to its unlocking state.

The plunger 160 extends along the longitudinal axis 102 and through the lock 140 and the center spindle 150. The plunger 160 is rotatable relative to the cam 142 and the center spindle 150 between its locking orientation and its unlocking orientation. While other offset angles are contemplated, in the illustrated form, the locking orientation and the unlocking orientation are angularly offset from one another by about 90°. Rotation of the plunger 160 from the unlocking orientation to the locking orientation rotates the cam follower 144 relative to the cam 142, thereby causing the ramp 143 to urge the follower 144 and the locking bar 146 to the locking positions thereof against the biasing force of the spring 149. Conversely, rotation of the plunger 160 from the locking orientation to the unlocking orientation permits the biasing member 149 to drive the follower 144 and the locking bar 146 to the unlocking positions thereof as the follower 144 travels along the ramp 143.

An inner end portion 161 of the plunger 160 is engaged with the inside lock input device 119 such that the inside lock input device 119 is operable to rotate the plunger 160 at least from its unlocking orientation to its locking orientation to lock the lockset 100. In certain embodiments, the inside lock input device 119 may further be operable to rotate the plunger 160 from its locking orientation to its unlocking orientation to unlock the lockset 100, while in other embodiments, unlocking from the inside may be performed only by rotation of the inside handle 116. In certain embodiments, the inside lock input device 119 may be a turnpiece, while in other embodiments, the input device 119 may be a pushbutton mechanism. Certain exemplary forms of pushbutton mechanisms are described below with reference to FIGS. 4-12.

An outer end portion 162 of the plunger 160 is engaged with the outside lock input device 129 such that the outside lock input device 129 is operable to rotate the plunger 160 at least from its locking orientation to its unlocking orientation to provide for override of the locked condition. In certain embodiments, the outside lock input device 129 may further be operable to rotate the plunger 160 from its unlocking orientation to its locking orientation to lock the lockset 100. In certain forms, the outside lock input device 129 may be a manually-operable turnpiece, a tool-operated turnpiece, or a lock cylinder.

Figure 4:
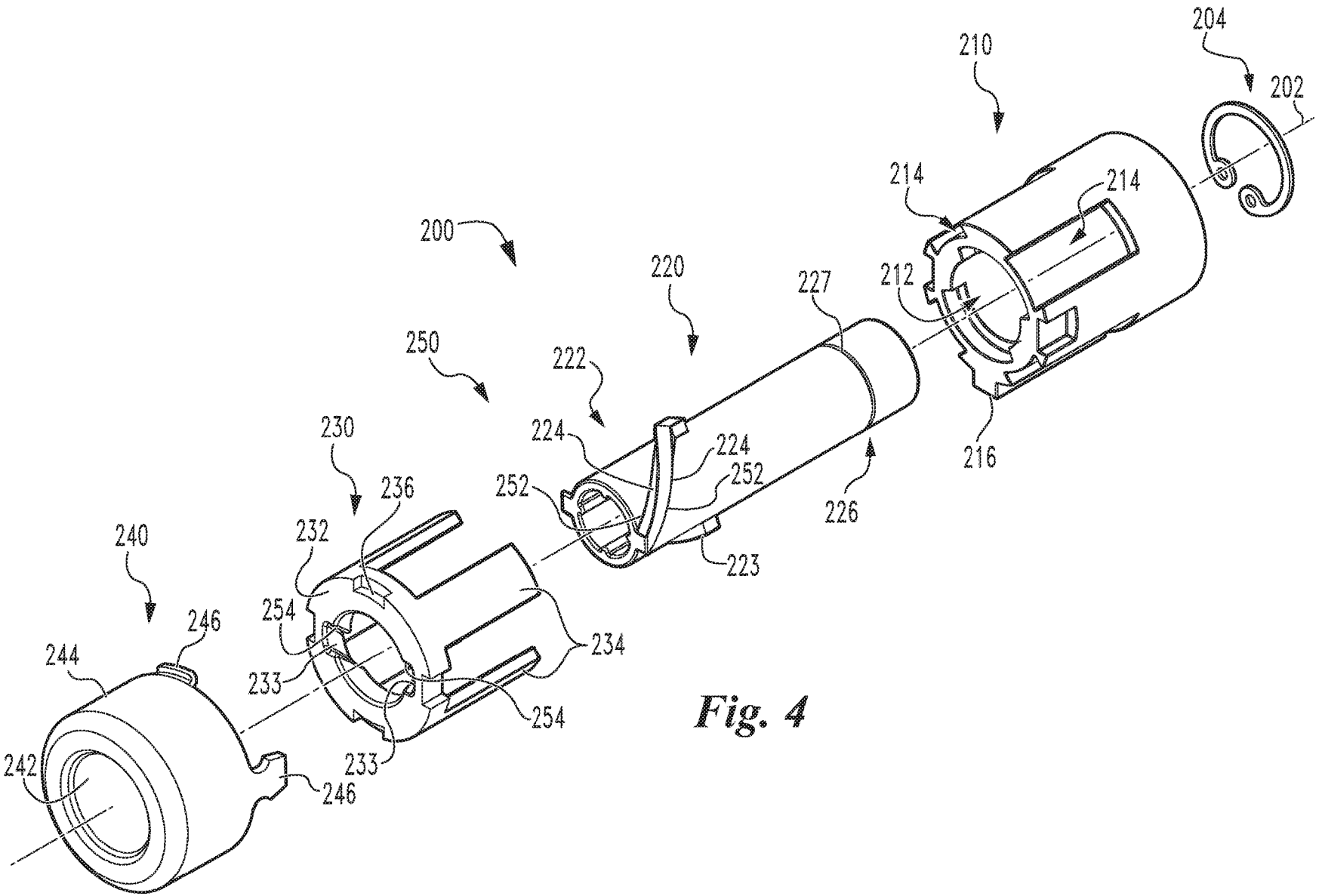
FIG. 4 is an exploded assembly view of a pushbutton mechanism according to certain embodiments.
Figure 5:
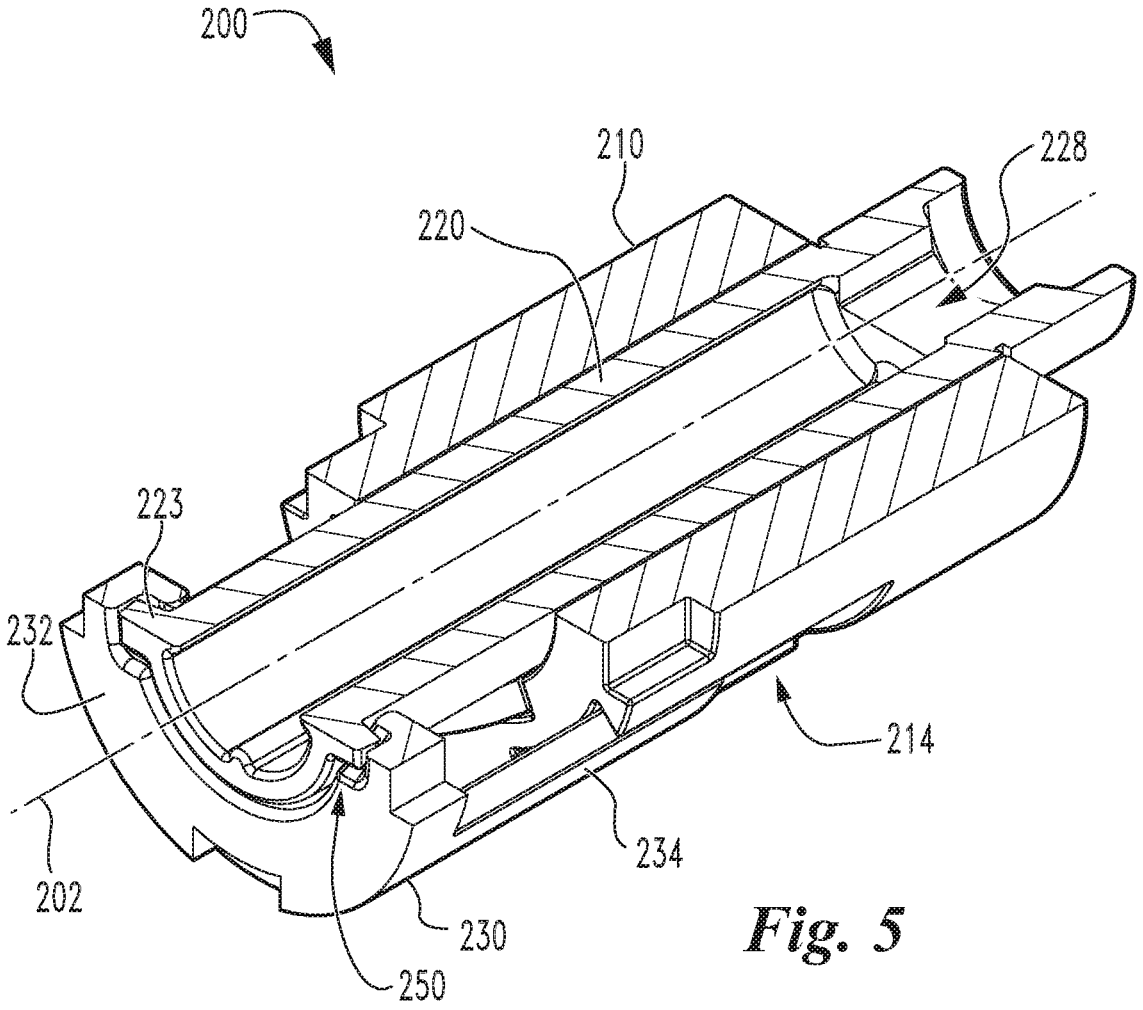
FIG. 5 is a cutaway view of a portion of the pushbutton mechanism illustrate in FIG. 4.
Figure 8A:
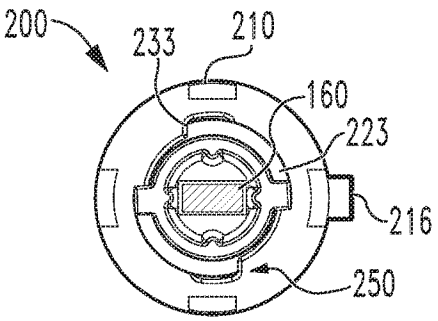
FIG. 8A is an end view of the pushbutton mechanism illustrated in FIG. 4 while in a locking state.
Figure 7A:
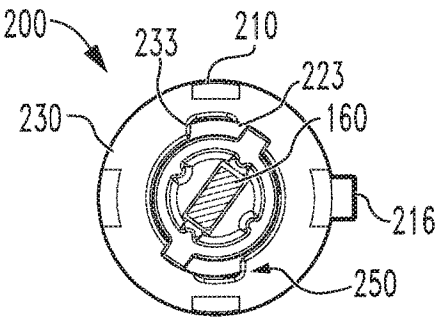
FIG. 7A is an end view of the pushbutton mechanism illustrated in FIG. 4 while in an intermediate state.

With additional reference to FIGS. 4 and 5, illustrated therein is a modular pushbutton mechanism 200 that may, for example, be utilized as the inside lock input device 119 of the lockset 100 illustrated in FIGS. 1-3. The pushbutton mechanism 200 generally includes a hub 210 configured for mounting in the inside spindle 114, a cam shaft 220 rotatably mounted to the hub 210, a slider 230 slidably mounted to the hub 210, and a pushbutton 240 coupled with the slider 230. As described herein, the cam shaft 220 is an example of a first component configured for rotational coupling with the plunger 160 and for axial coupling with the spindle 114, and the slider 230 is an example of a second component configured for rotational coupling with the spindle 114 and for axial displacement relative to the spindle 114. The pushbutton mechanism 200 further includes a cam interface 250 that correlates rotation of the first component of cam shaft 220 with axial displacement of the second component or slider 230.

The hub 210 includes a central opening 212 in which the cam shaft 220 is rotatably mounted, and an outer periphery of the hub 210 defines at least one longitudinal channel 214 and a radial spline 216. In the illustrated form, the hub 210 includes a plurality of the channels 214, which facilitate the slidable rotational coupling of the hub 210 and the slider 230 as described herein. The spline 216 engages a slot 115 formed in the inside spindle 114 to rotationally couple the hub 210 with the spindle 114.

The cam shaft 220 includes a front portion 222 that engages the slider 230 and a rear portion 226 that extends through the central opening 212 of the hub 210. The front portion 222 includes at least one helical ridge 223, and in the illustrated form includes a pair of diametrically opposite helical ridges 223, each of which defines a pair of helical ramps 224. The rear portion 226 includes an opening 228 operable to receive the interior end portion 161 of the plunger 160 such that the cam shaft 220 and the plunger 160 are slidably engaged and rotationally coupled. In other words, the cam shaft 220 is longitudinally slidable along the plunger 160, and the cam shaft 220 and the plunger 160 are coupled for joint rotation about a longitudinal axis 202. While other forms are contemplated, in the illustrated embodiment, the opening 228 has a generally rectangular cross-section that corresponds to the rectangular cross-section of the interior end portion 161. The rear portion 226 may further define a circumferential groove 227 that engages with a circlip 204 to restrict longitudinal movement of the cam shaft 220 relative to the hub 210 in a forward direction. When installed to the lockset 100, longitudinal movement of the cam shaft 220 in the rearward direction may be restricted by engagement of the cam shaft 220 and/or the circlip 204 with the retainer plate 111.

The slider 230 includes a generally annular base plate 232 defining a central opening 231, and at least one spline 234 extending longitudinally from the base plate 232. In the illustrated form, the slider 230 includes a plurality of the splines 234. The splines 234 are received in the channels 214 such that the hub 210 and the slider 230 are slidably engaged and rotationally coupled. Formed on a radially-inner side of the annular base plate 232 and connected with the central opening 231 is at least one slot 233 corresponding to the at least one helical ridge 223. In certain embodiments, the slot 233 itself may be helical. The helical ridges 223 are engaged with the slots 233 such that longitudinal movement of the slider 230 is correlated with rotation of the cam shaft 220. The slider 230 may further include one or more recesses 236, which may facilitate coupling of the slider 230 and the pushbutton 240 as described herein.

The pushbutton 240 is generally cylindrical, and includes an end wall 242, an annular wall 244 extending from the end wall 242, and one or more clip arms 246 extending from the end of the annular wall 244. The clip arms 246 engage the recesses 236 to couple the pushbutton 240 with the slider 230 for joint movement along the longitudinal axis 202.

The cam interface 250 generally includes a pair of helical ramps 252 and a pair of followers 254 engaged with the pair of helical ramps 252. In the illustrated form, the cam interface 250 includes two pairs of helical ramps 252, each of which pairs is defined by a corresponding one of the helical ridges 223. More particularly, each ridge 223 defines a forward-facing helical ramp 224, 252 and a rearward-facing helical ramp 224, 252. Similarly, the cam interface 250 includes two pairs of followers 254, each of which defines a corresponding one of the slots 233. More particularly, a first edge of each slot 233 defines a first follower 254 that engages a corresponding one of the forward-facing helical ramps 252, and a second edge of each slot 233 defines a second follower 254 that engages a corresponding one of the rearward-facing helical ramps 252. In the illustrated form, the followers 254 are provided in the form of helical ramps that define the slots 233.

With additional reference to FIGS. 6-8, the pushbutton mechanism 200 is configured to translate depression of the pushbutton 240 to rotation of the plunger 160 from the unlocking orientation (FIG. 6) through an intermediate orientation (FIG. 7) to the locking orientation (FIG. 8). As described herein, the pushbutton mechanism 200 is further configured to translate rotation of the plunger 160 from the locking orientation to the unlocking orientation to projection of the pushbutton 240. For purposes of clarity, the pushbutton 240 has been omitted from FIGS. 6-8.

Figure 6A:
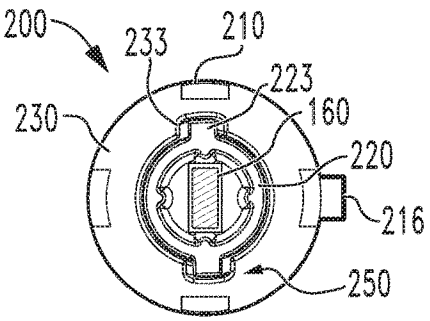
FIG. 6A is an end view of the pushbutton mechanism illustrated in FIG. 4 while in an unlocking state.
Figure 8B:
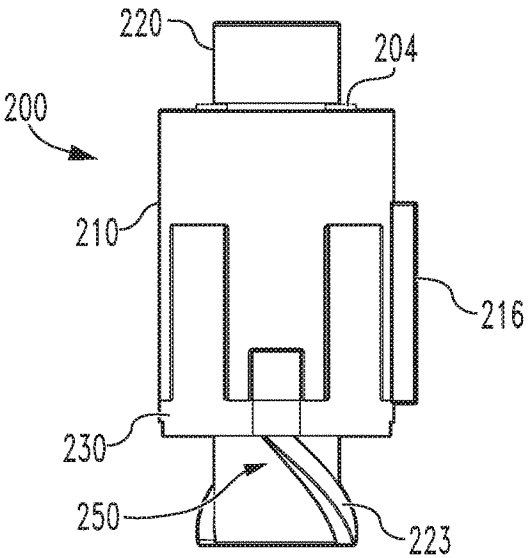
FIG. 8B is a plan view of the pushbutton mechanism illustrated in FIG. 4 while in the locking state.
Figure 7B:
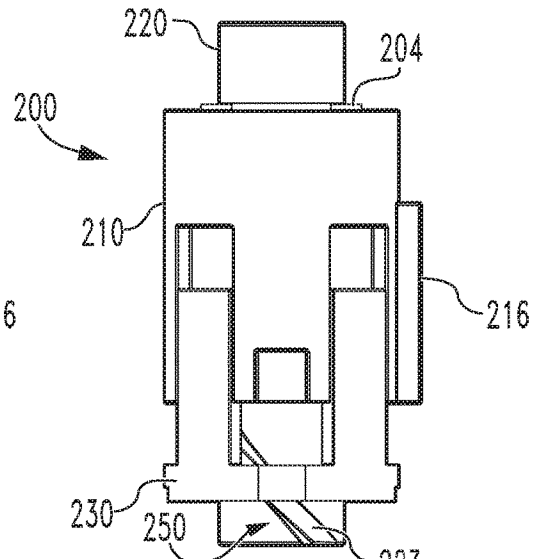
FIG. 7B is a plan view of the pushbutton mechanism illustrated in FIG. 4 while in the intermediate state.
Figure 6B:
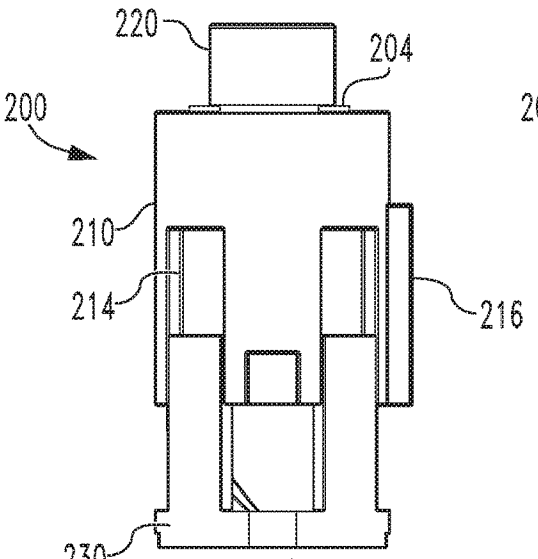
FIG. 6B is a plan view of the pushbutton mechanism illustrated in FIG. 4 while in the unlocking state.

As noted above, when the lock 140 is in its unlocked state, the plunger 160 is in its unlocking orientation. This state is illustrated in FIGS. 6A and 6B. As the user manually depresses the pushbutton 240, the slider 230 begins to move rearward (upward in FIGS. 6B, 7B, and 8B, to the left in FIG. 1) relative to the hub 210 and the cam shaft 220. Due to the fact that the slider 230 is rotationally coupled with the spindle 114 (via the hub 210) and longitudinal movement of the cam shaft 220 is restricted (e.g., by the circlip 204), engagement between the helical ridge 223 and the slots 233 forces the cam shaft 220 to rotate in a locking direction (clockwise in FIGS. 6A, 7A, and 8A) in response to rearward movement of the slider 230. In other words, the cam interface 250 causes the first component 220 to rotate in response to axial displacement of the second component 230. As a result, the plunger 160 rotates with the cam shaft 220 from the unlocking orientation to the locking orientation in response to depression of the pushbutton 240.

From the locked state (FIG. 8), the lock 140 may transition to the unlocked state, for example, as a result of actuation of the latchbolt mechanism 130 by the inside handle 116 or as a result of unlocking by the outside lock input 119. Such transitioning causes the plunger 160 to rotate in an unlocking direction (counter-clockwise in FIGS. 6A, 7A, and 8A) opposite the locking direction. Due to the fact that the slider 230 is rotationally coupled with the spindle 114 (via the hub 210) and longitudinal movement of the cam shaft 220 is restricted (e.g., by the circlip 204), engagement between the helical ridge 223 and the slots 233 forces the slider 230 to move forward (i.e., toward its projected position) in response to the unlocking rotation of the cam shaft 220. In other words, the cam interface 250 causes axial displacement of the second component 230 in response to rotation of the first component 220. As a result, the pushbutton 240 returns to its projected position in response to unlocking of the lock 140.

Figure 9:
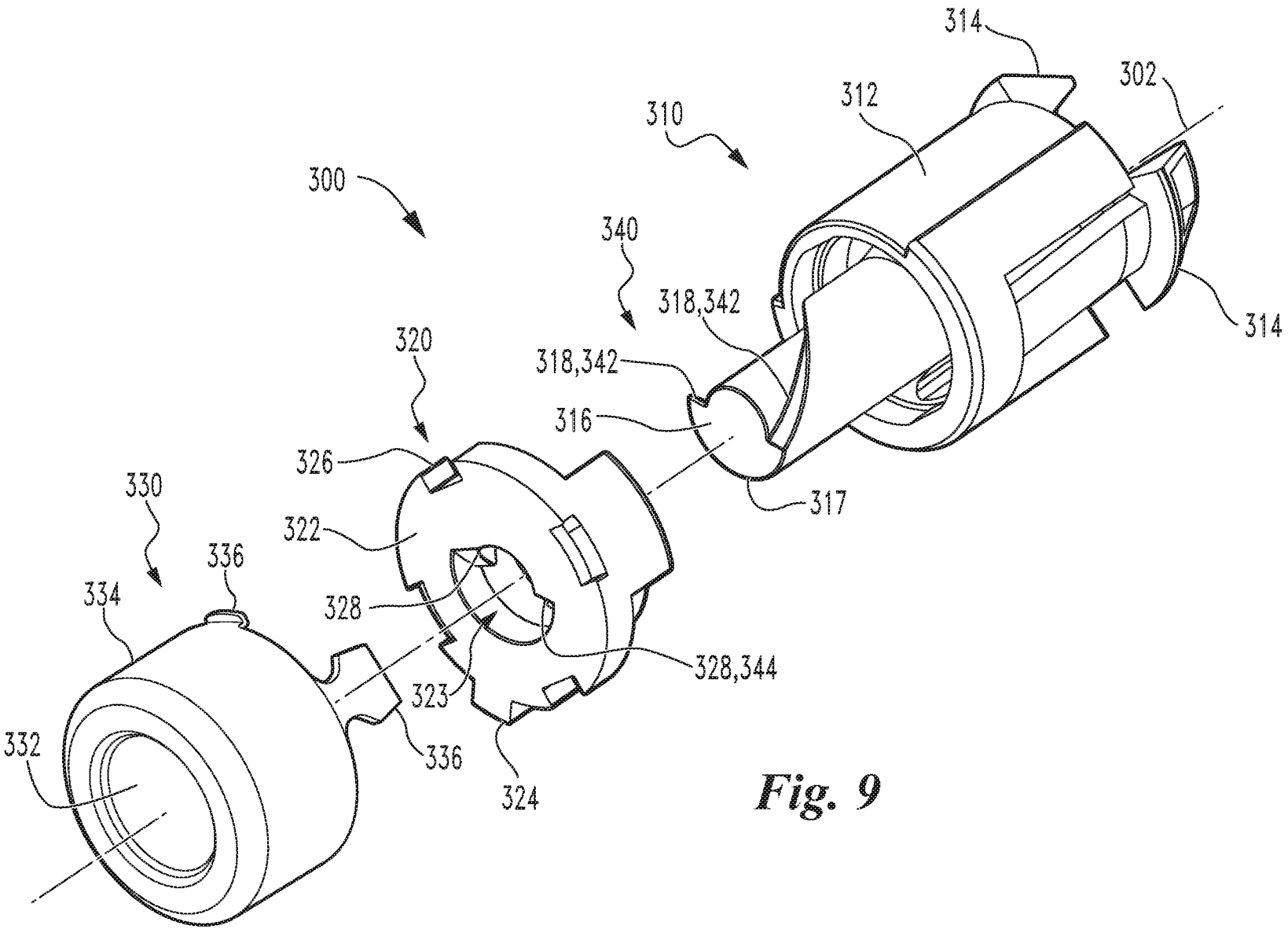
FIG. 9 is an exploded assembly view of a pushbutton mechanism according to certain embodiments.
Figure 10:
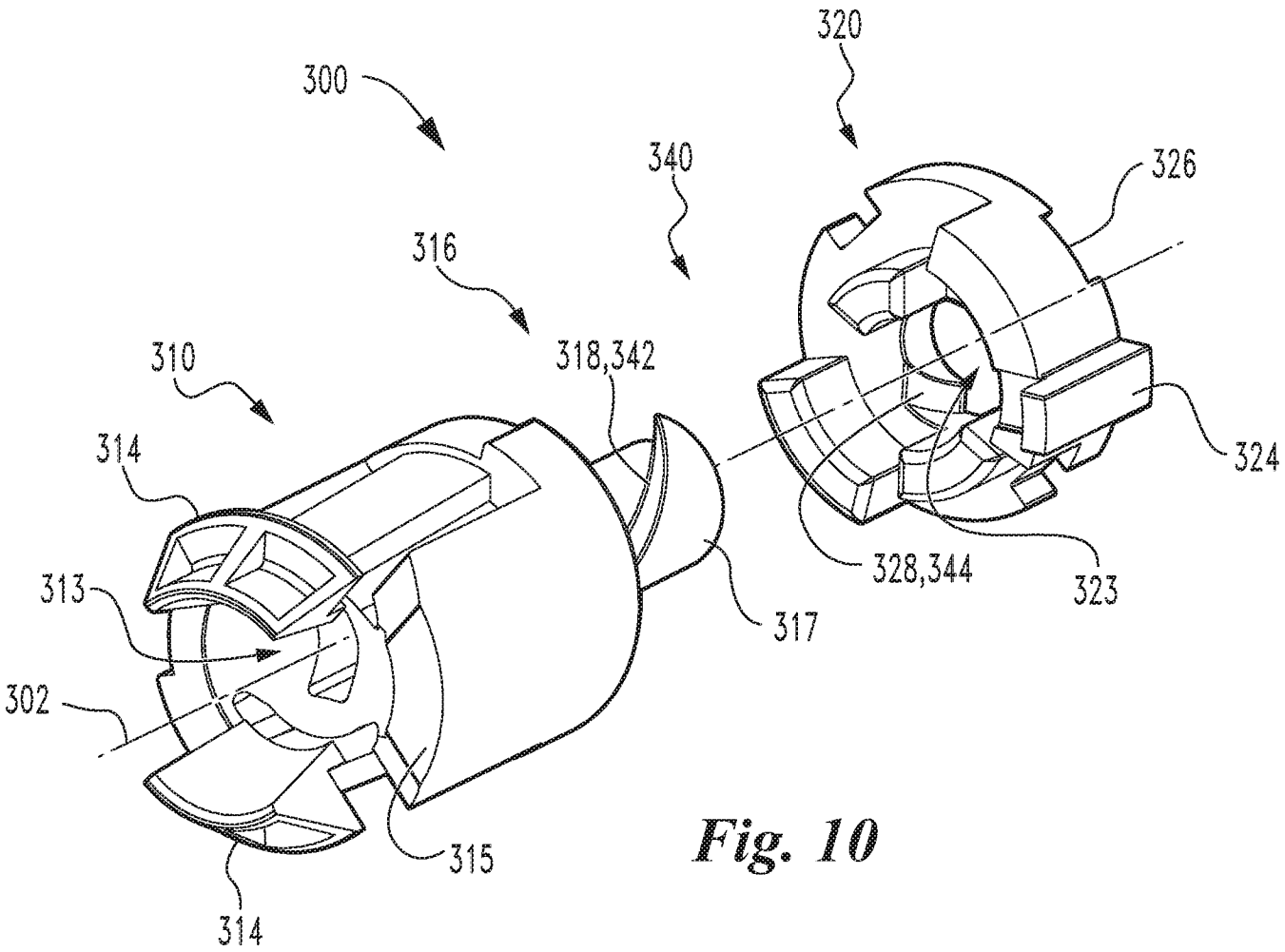
FIG. 10 is an exploded assembly view of a portion of the pushbutton mechanism illustrated in FIG. 9.

With additional reference to FIGS. 9 and 10, illustrated therein is a modular pushbutton mechanism 300 that may, for example, be utilized as the inside lock input device 119 of the lockset 100 illustrated in FIGS. 1-3. The pushbutton mechanism 300 generally includes a hub 310 configured for connection with the plunger 160, a slider 320 slidably and rotatably engaged with the hub 310, and a pushbutton 330 coupled with the slider 320. As described herein, the hub 310 is an example of a first component configured for rotational coupling with the plunger 160 and for axial coupling with the spindle 114, and the slider 320 is an example of a second component configured for rotational coupling with the spindle 114 and for axial displacement relative to the spindle 114. The pushbutton mechanism 300 further includes a cam interface 340 that correlates rotation of the first component or hub 310 with axial displacement of the second component or slider 320.

The hub 310 generally includes a body portion 312 and a post 316 extending from the body portion 312. The body portion 312 defines an opening 313 operable to receive the interior end portion 161 of the plunger 160 such that the hub 310 and the plunger 160 are slidably engaged and rotationally coupled. While other forms are contemplated, in the illustrated embodiment, the opening 313 has a generally rectangular cross-section that corresponds to the rectangular cross-section of the interior end portion 161. Projecting from the rear side of the body portion 312 are a pair of deformable clip arms 314 that are longitudinally offset from a rear shoulder 315 of the body portion 312. The clip arms 314 pass through the retainer plate 111 such that the retainer plate 111 is captured between the forward ends of the clip arms 314 and the rear shoulder 315. As a result, the hub 310 is rotatably coupled with the retainer plate 111, which restricts longitudinal movement of the hub 310. The post 316 extends forward from the body portion 312, and includes a helical ridge 317 that defines a pair of helical ramps 318.

The slider 320 includes a base plate 322 defining a central opening 323, a spline 324 extending radially from the base plate 322, a plurality of recesses 326 formed about the outer periphery of the base plate 322, and a pair of helical ramps 328 defined within the central opening 323. The opening 323 is sized and shaped to receive the post 316 such that the helical ramps 318 of the post 316 mate with the helical ramps 328 defined within the opening 323. The spline 324 is received in the slot 115 formed in the inside spindle 114 such that the slider 320 is rotationally coupled with the spindle 114 and is slidable in the longitudinal direction. The recesses 326 mate with clip arms 336 on the pushbutton 330 to couple the slider 320 and the pushbutton 330 for joint longitudinal movement. The slider ramps 328 engage the hub ramps 318 such that movement of the slider 320 along the longitudinal axis 302 is correlated with rotation of the hub 310 about the longitudinal axis 302.

The pushbutton 330 is generally cylindrical, and includes an end wall 332, an annular wall 334 extending from the end wall 332, and one or more clip arms 336 extending from the end of the annular wall 334. The clip arms 336 engage the recesses 326 to couple the pushbutton 330 with the slider 230 for joint movement along the longitudinal axis 302.

The cam interface 340 generally includes a pair of helical ramps 342 and a pair of followers 344 engaged with the pair of helical ramps 342. In the illustrated form, the cam interface 340 includes a first pair of helical ramps 342, which are defined by the hub ramps 318. More particularly, the first component or hub 310 defines a forward-facing helical ramp 318, 342 and a rearward-facing helical ramp 318, 342. The cam interface 340 further includes a pair of followers 344 in the form of a second pair of helical ramps 328 defined by the second component or slider 320. More particularly, a forward-facing ramp 328 defines a first follower 344 that engages the rearward-facing helical ramp 318, 342 of the first component 310, and a rearward-facing ramp 328 defines a second follower 344 that engages the forward-facing helical ramp 318 342 of the first component 310. Thus, in the illustrated form, the followers 344 are provided in the form of helical ramps 328 that partially define the opening 323.

As noted above, when the lock 140 is in its unlocked state, the plunger 160 is in its unlocking orientation. As the user manually depresses the pushbutton 330, the slider 320 begins to move rearward (to the left in FIG. 1) relative to the hub 310. Due to the fact that the slider 320 is rotationally coupled with the spindle 114 (via the spline 324) and longitudinal movement of the hub 310 is restricted (e.g., by the retainer plate 111), engagement between the hub ramps 318 and the slider ramps 328 forces the hub 310 to rotate in a locking direction in response to rearward movement of the slider 320. In other words, the cam interface 340 causes the first component 310 to rotate in response to axial displacement of the second component 320. As a result, the plunger 160 rotates with the hub 310 from the unlocking orientation to the locking orientation when the pushbutton 330 is depressed.

From the locked state, the lock 140 may transition to the unlocked state, for example, as a result of actuation of the latchbolt mechanism 130 by the inside handle 116 or as a result of unlocking by the outside lock input 119. Such transitioning causes the plunger 160 to rotate in an unlocking direction opposite the locking direction. Due to the fact that the slider 320 is rotationally coupled with the spindle 114 (via the spline 324) and longitudinal movement of the hub 310 is restricted (e.g., by the retainer plate 111), engagement between the hub ramps 318 and the slider ramps 328 forces the slider 320 to move forward (i.e., toward its projected position) in response to the unlocking rotation of the hub 310. In other words, the cam interface 340 causes axial displacement of the second component 320 in response to rotation of the first component 3100. As a result, the pushbutton 330 returns to its projected position in response to unlocking of the lock 140.

Figure 11:
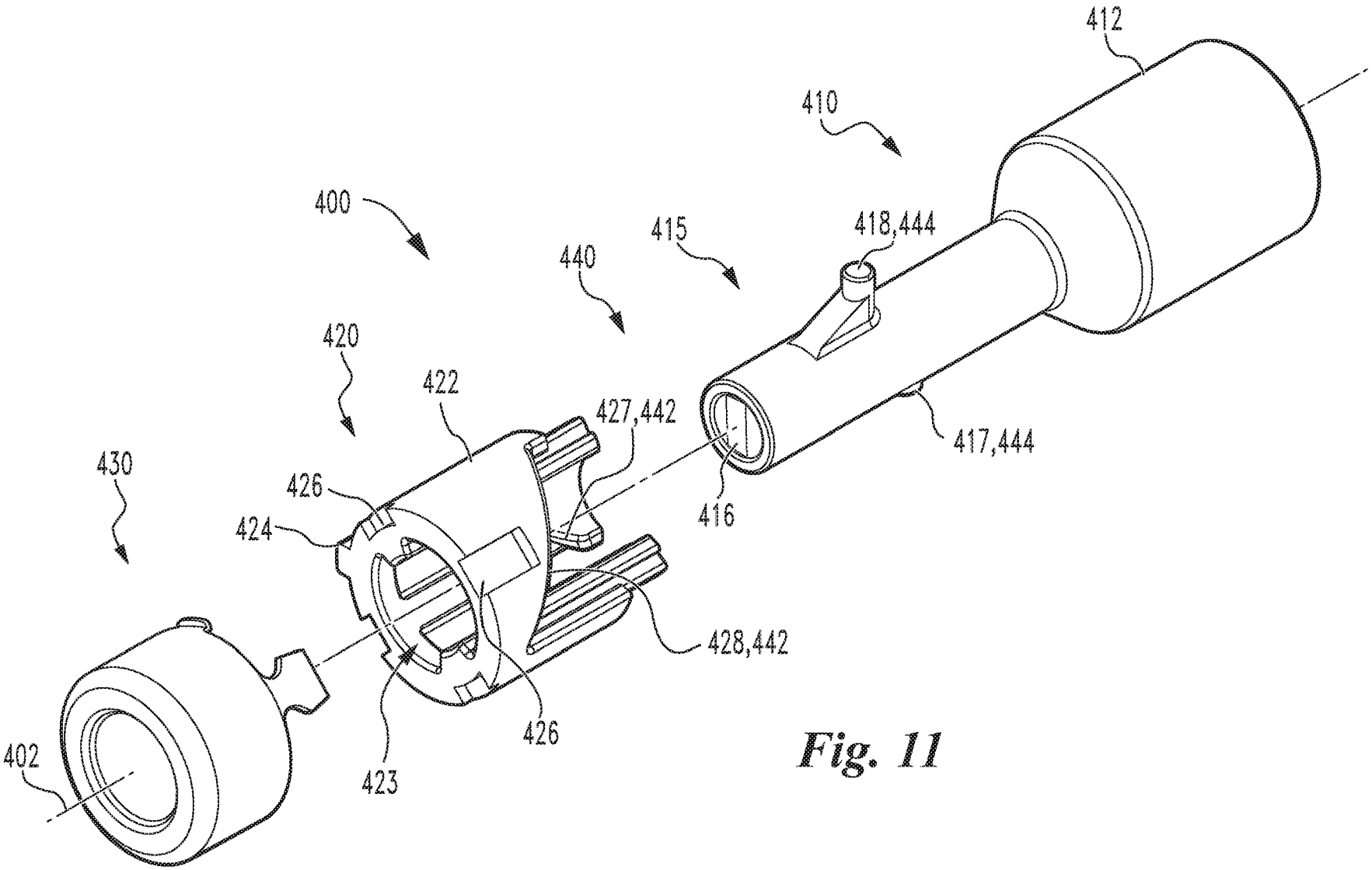
FIG. 11 is an exploded assembly view of a pushbutton mechanism according to certain embodiments.
Figure 12:
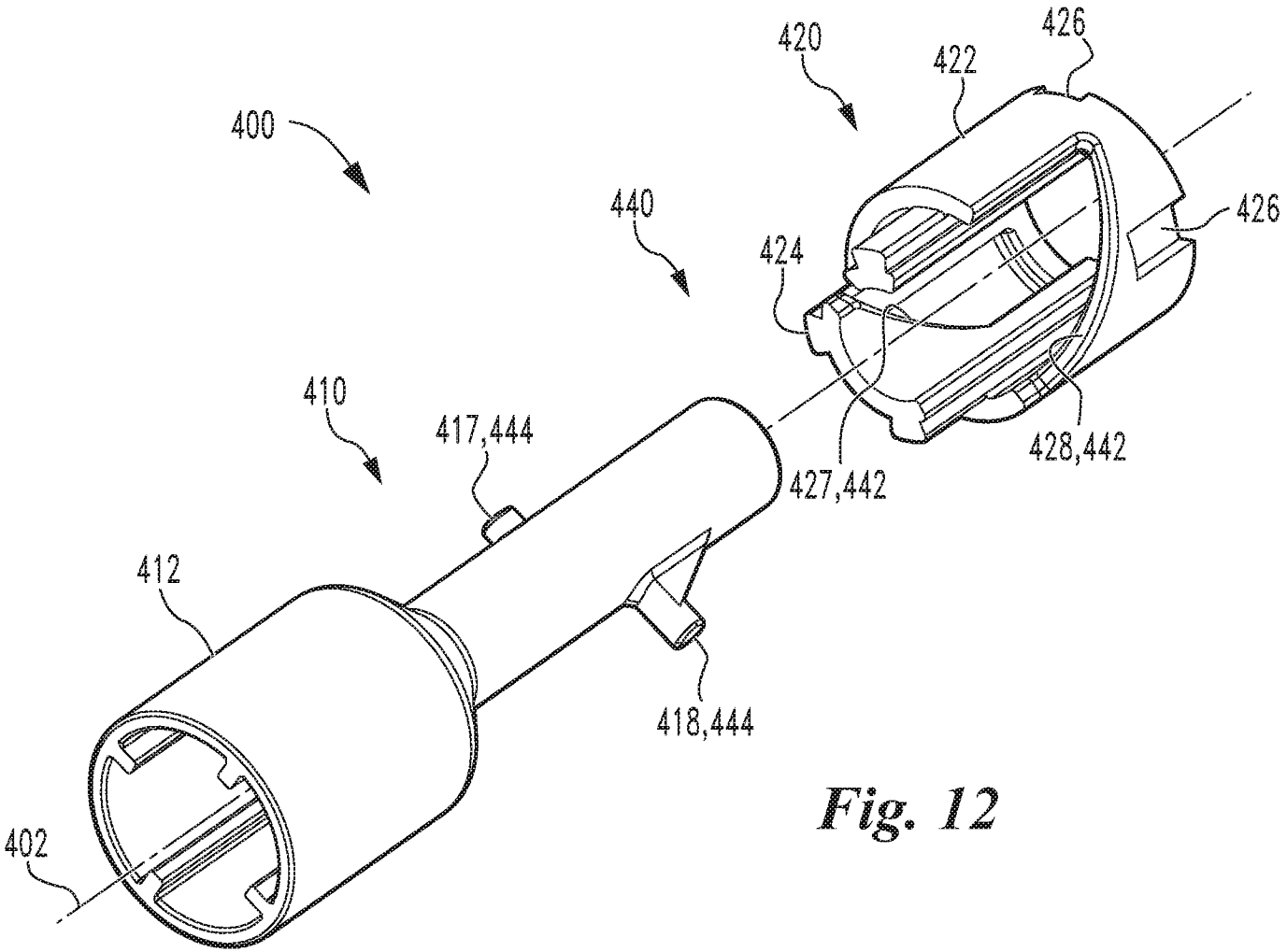
FIG. 12 is an exploded assembly view of a portion of the pushbutton mechanism illustrated in FIG. 11.

With additional reference to FIGS. 11 and 12, illustrated therein is a modular pushbutton mechanism 400 that may, for example, be utilized as the inside lock input device 119 of the lockset 100 illustrated in FIGS. 1-3. The pushbutton mechanism 400 generally includes a hub 410 configured for connection with the plunger 160, a slider 420 slidably and rotatably engaged with the hub 410, and a pushbutton 430 coupled with the slider 420. As described herein, the hub 410 is an example of a first component configured for rotational coupling with the plunger 160 and for axial coupling with the spindle 114, and the slider 420 is an example of a second component configured for rotational coupling with the spindle 114 and for axial displacement relative to the spindle 114. The pushbutton mechanism 400 further includes a cam interface 440 that correlates rotation of the first component 410 with axial displacement of the second component 420.

The hub 410 generally includes a body portion 412 and a post 415 extending forward from the body portion 412. The body portion 412 is generally cylindrical, and is configured for mounting within the inside spindle 114 such that the spindle 114 rotatably supports the hub 410. The body portion 412 may be captured between the spring cage 118 and the retainer plate 111 such that longitudinal movement of the hub 410 is restricted. The post 415 includes an opening 416 operable to receive the interior end portion 161 of the plunger 160 such that the hub 410 and the plunger 160 are slidably engaged and rotationally coupled. While other forms are contemplated, in the illustrated embodiment, the opening 416 has a generally rectangular cross-section that corresponds to the rectangular cross-section of the interior end portion 161. The post 415 further includes a pair of lugs 417, 418 that project radially from the post 415. In the illustrated form, the lugs 417, 418 are axially or longitudinally offset from one another, and define followers 444 of the cam interface 440.

The slider 420 includes a body portion 422 defining a central opening 423 operable to receive the post 415, a spline 424 extending radially from the body portion 422, and a pair of helical ramps 427, 428. Each ramp 427, 428 is engaged with a corresponding one of the lugs 417, 418 such that movement of the slider 420 along the longitudinal axis 402 is correlated with rotation of the hub 410 about the longitudinal axis 402. The recesses 426 mate with clip arms 436 of the pushbutton 430 to couple the slider 420 and the pushbutton 430 for joint longitudinal movement.

The pushbutton 430 is generally cylindrical, and includes an end wall 432, an annular wall 434 extending from the end wall 432, and one or more clip arms 436 extending from the end of the annular wall 434. The clip arms 436 engage the recesses 426 to couple the pushbutton 430 with the slider 230 for joint movement along the longitudinal axis 402.

The cam interface 440 generally includes a pair of helical ramps 442 and a pair of followers 444 engaged with the pair of helical ramps 442. In the illustrated form, the helical ramps 442 are defined by the helical ramps 427, 428 of the second component 420. More particularly, the second component or slider 420 defines a forward-facing helical ramp 427, 442 and a rearward-facing helical ramp 428, 442. The cam interface 440 further includes a pair of followers 444 defined by the lugs 417, 418. More particularly, the first lug 417 defines a first follower 444 that engages the rearward-facing helical ramp 427, 442, and the second lug 418 defines a second follower 444 that engages the rearward-facing helical ramp 428, 442.

As noted above, when the lock 140 is in its unlocked state, the plunger 160 is in its unlocking orientation. As the user manually depresses the pushbutton 430, the slider 420 begins to move rearward (to the left in FIG. 1) relative to the hub 410. Due to the fact that the slider 420 is rotationally coupled with the spindle 114 (via the spline 424) and longitudinal movement of the hub 410 is restricted (e.g., by the retainer plate 111 and/or the spring cage 118), engagement between the lugs 417, 418 and the helical ramps 427, 428 forces the hub 410 to rotate in a locking direction in response to rearward movement of the slider 420. In other words, the cam interface 440 causes the first component 410 to rotate in response to axial displacement of the second component 420. As a result, the plunger 160 rotates with the hub 410 from the unlocking orientation to the locking orientation when the pushbutton 430 is depressed.

From the locked state, the lock 140 may transition to the unlocked state, for example, as a result of actuation of the latchbolt mechanism 130 by the inside handle 116 or as a result of unlocking by the outside lock input 119. Such transitioning causes the plunger 160 to rotate in an unlocking direction opposite the locking direction. Due to the fact that the slider 420 is rotationally coupled with the spindle 114 (via the spline 424) and longitudinal movement of the hub 410 is restricted (e.g., by the retainer plate 111 and/or the spring cage 118), engagement between the lugs 417, 418 and the helical ramps 427, 428 forces the slider 420 to move forward (i.e., toward its projected position) in response to the unlocking rotation of the hub 410. In other words, the cam interface 440 causes axial displacement of the second component 420 in response to rotation of the first component 410. As a result, the pushbutton 430 returns to its projected position in response to unlocking movement of the lock 140.

Figure 13:
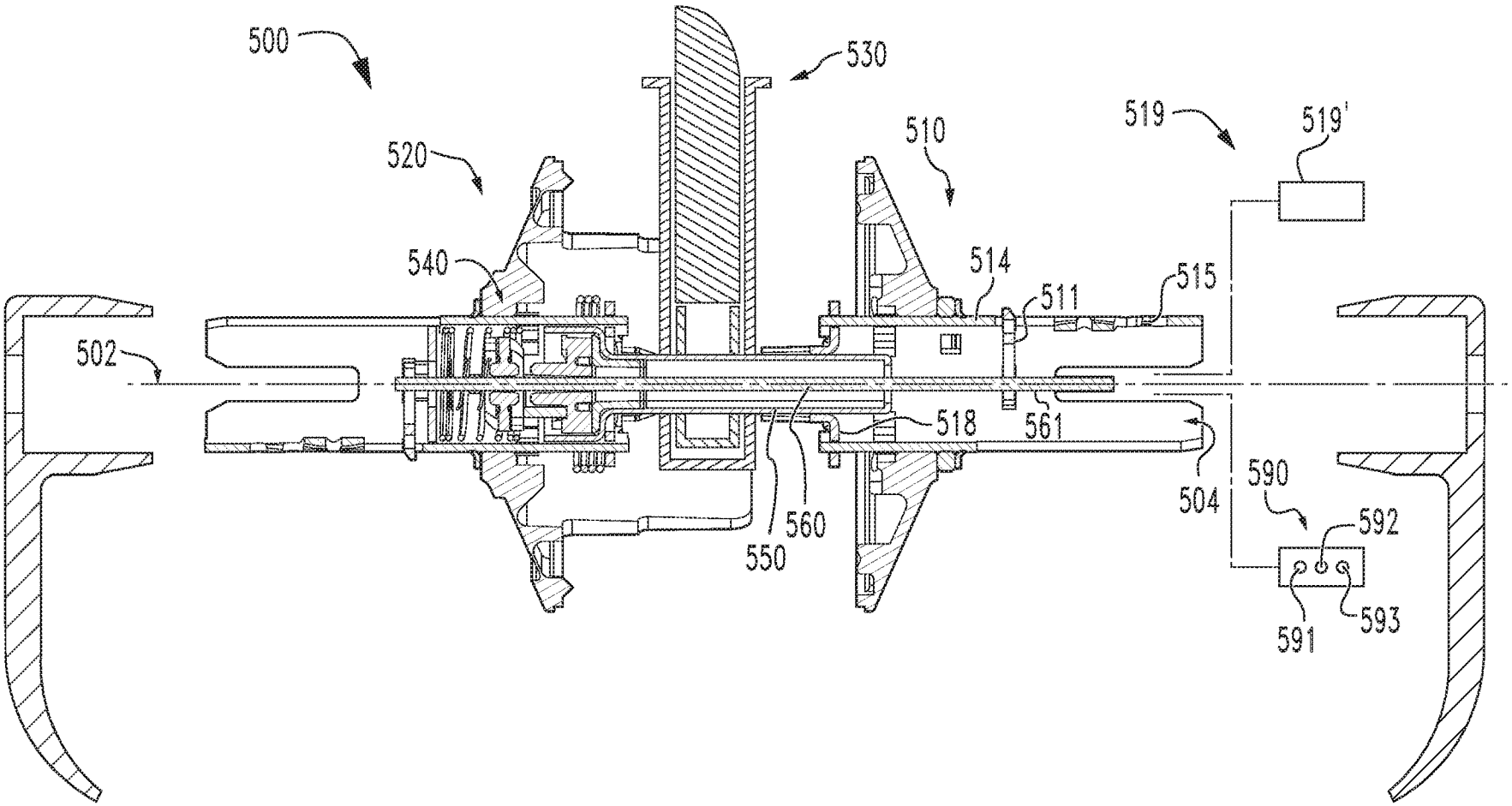
FIG. 13 is a cross-sectional view of a lockset according to certain embodiments, and schematically illustrates a pair of inside lock input devices configured for use with the lockset.

With additional reference to FIG. 13, illustrated therein is a configurable lockset 500 according to certain embodiments. The lockset 500 is substantially similar to the above-described lockset 100, and similar reference characters are used to indicate similar elements and features. For example, the illustrated lockset 500 generally includes an inside assembly 510, an outside assembly 520, a latchbolt mechanism 530, a lock 540, a center spindle 550, and a plunger 560, which respectively correspond to the inside assembly 110, the outside assembly 120, the latchbolt mechanism 130, the lock 140, the center spindle 150, and the plunger 160. In the interest of conciseness, the following description of the lockset 500 focuses primarily on elements and features of the lockset 500 that are different from those described above and/or that were not specifically described above with reference to the lockset 100.

As with the above-described lockset 100, the lockset 500 includes an inside lock input device 519 that is mounted in the inside spindle 514 and engaged with the plunger 560. In certain embodiments, the inside lock input device 519 is provided in the form of a thumbturn actuator 519' that rotationally couples with the plunger 560. In other embodiments, the inside lock input device 519 is provided in the form of a pushbutton mechanism 590. As described herein, the lockset 500 is operable to be converted between a first configuration in which the lockset 500 comprises the thumbturn actuator 519' and a second configuration in which the lockset 500 comprises the pushbutton mechanism 590.

The pushbutton mechanism 590 generally includes a first component 591 configured for rotational coupling with the plunger 560, a second component 592 configured for rotational coupling with the inside spindle 514, and a cam interface 594 configured to correlate rotation of the first component 591 with axial displacement of the second component 592. With the lockset 500 in the second configuration, the first component 591 is rotationally coupled with the plunger 560 and is axially coupled with the inside spindle 514, the second component 592 is rotationally coupled with the inside spindle 514 and is axially slidable relative to the inside spindle 514, and the cam interface 594 correlates rotation of the first component 591 between an unlocking orientation and a locking orientation with axial displacement of the second component 592 between a projected position and a depressed position.

In certain embodiments, the pushbutton mechanism 590 may be provided in the form of the above-described pushbutton mechanism 200. In such forms, the first component 591 may be provided in the form of the cam shaft 220, the second component 592 may be provided in the form of the slider 230, and the cam interface 594 may be provided in the form of the cam interface 250. When installed to the lockset 500, such an embodiment of the pushbutton mechanism 590 will operate along the lines described above with reference to FIGS. 4-8.

In certain embodiments, the pushbutton mechanism 590 may be provided in the form of the above-described pushbutton mechanism 300. In such forms, the first component 591 may be provided in the form of the hub 310, the second component 592 may be provided in the form of the slider 320, and the cam interface 594 may be provided in the form of the cam interface 340. When installed to the lockset 500, such an embodiment of the pushbutton mechanism 590 will operate along the lines described above with reference to FIGS. 9 and 10.

In certain embodiments, the pushbutton mechanism 590 may be provided in the form of the above-described pushbutton mechanism 400. In such forms, the first component 591 may be provided in the form of the hub 410, the second component 592 may be provided in the form of the slider 420, and the cam interface 594 may be provided in the form of the cam interface 440. When installed to the lockset 500, such an embodiment of the pushbutton mechanism 590 will operate along the lines described above with reference to FIGS. 11 and 12.

Figure 14:
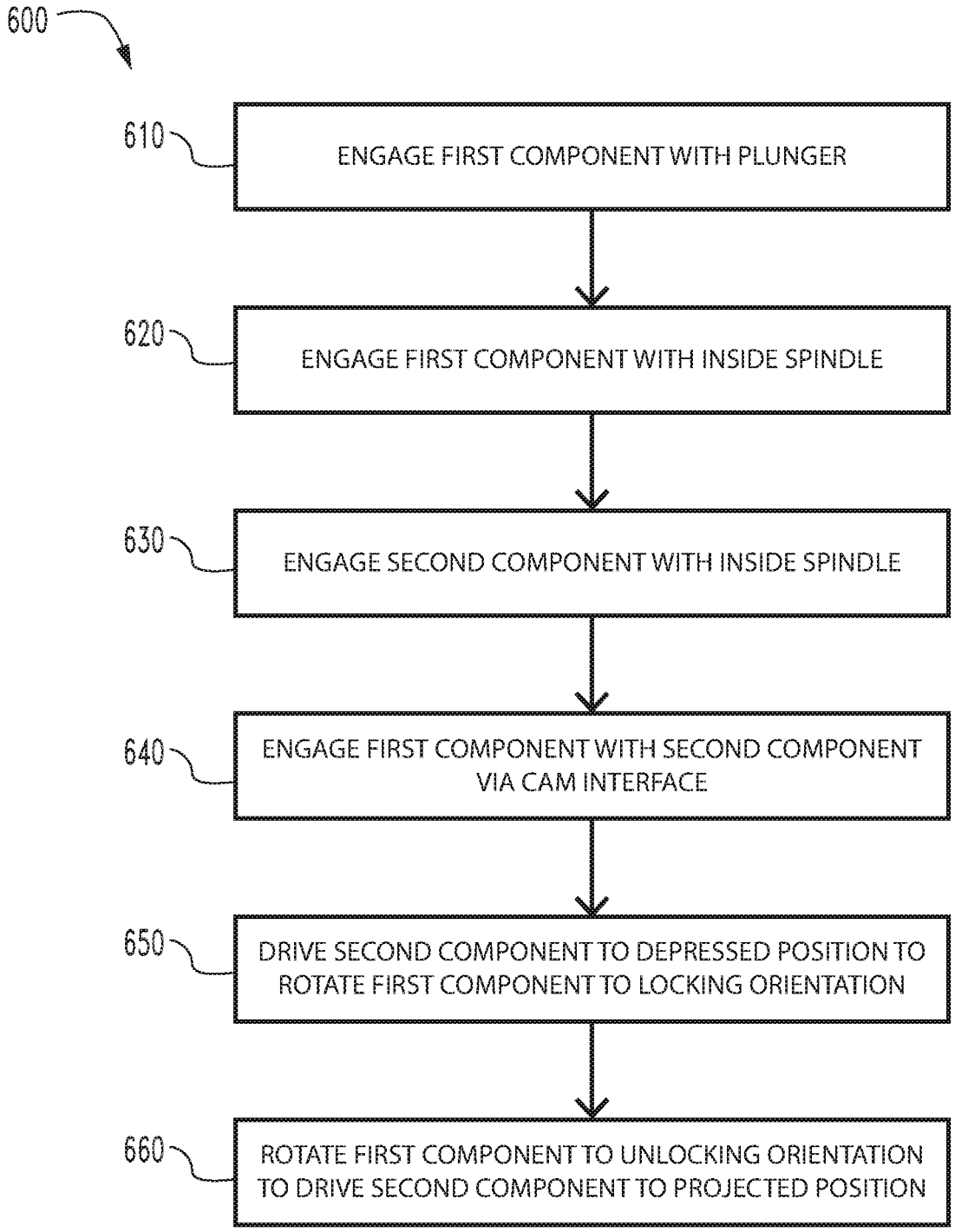
FIGS. 14-16 are schematic flow diagrams of processes according to certain embodiments.

With additional reference to FIG. 14, an exemplary process 600 that may be performed using the lockset 500 and/or one of the pushbutton mechanisms 200, 300, 400 is illustrated. Blocks illustrated for the processes in the present application are understood to be examples only, and blocks may be combined or divided, and added or removed, as well as re-ordered in whole or in part, unless explicitly stated to the contrary. While the blocks are illustrated in a relatively serial fashion, it is to be understood that two or more of the blocks may be performed concurrently or in parallel with one another. Additionally, while the process 600 is described herein with specific reference to the lockset 500 illustrated in FIG. 13, it should be appreciated that other forms of locksets may be utilized.

The process 600 generally involves installing a pushbutton mechanism 590 to a lockset 500 including an inside spindle 514 rotatable about an axis 502, a plunger 560 extending into the inside spindle 514, and a lock 540 engaged with the plunger 560 such that rotation of the plunger 560 between an unlocking orientation and a locking orientation drives the lock 540 between an unlocked state corresponding to the unlocking orientation and a locking state corresponding to the locking orientation.

The process 600 generally involves block 610, which generally involves engaging the first component 591 with the plunger 560 such that the first component 591 is rotationally coupled with the plunger 560 for joint movement between the locking orientation and the unlocking orientation.

In embodiments in which the pushbutton mechanism 590 is provided in the form of the pushbutton mechanism 200, block 610 may involve inserting the inside end portion 561 of the plunger 560 into the opening 228 of the cam shaft 220 to slidably rotationally couple the plunger 560 with the cam shaft 220. Block 610 may further involve axially and rotationally coupling the hub 210 with the spindle 114 and positioning a portion of the rear portion 226 of the cam shaft 220 within the central opening 212 of the hub 210 such that the hub 210 rotatably supports the cam shaft 220.

In embodiments in which the pushbutton mechanism 590 is provided in the form of the pushbutton mechanism 300, block 610 may involve inserting the inside end portion 561 of the plunger 560 into the opening 313 of the hub 310 to slidably rotationally couple the plunger 560 with the hub 310. Block 610 may further involve positioning the body portion 312 in the inside spindle 514 such that the hub 310 is rotatably supported by the inside spindle 514.

In embodiments in which the pushbutton mechanism 590 is provided in the form of the pushbutton mechanism 400, block 610 may involve inserting the inside end portion 561 of the plunger 560 into the opening 416 of the hub 410 to slidably rotationally couple the plunger 560 with the hub 410. Block 610 may further involve positioning the body portion 412 in the inside spindle 514 such that the hub 410 is rotatably supported by the inside spindle 514.

The process 600 may further include block 620, which generally involves engaging the first component 591 with the inside spindle 514 such that the first component 591 is axially coupled with the inside spindle 514.

In embodiments in which the pushbutton mechanism 590 is provided in the form of the pushbutton mechanism 200, block 620 may involve capturing the circlip 204 between the rear side of the hub 210 and the front side of the retainer plate 511 such that axial movement of the cam shaft 220 is restricted in both forward and rearward directions. In certain forms, block 620 may involve positioning the circlip 204 within the annular groove 227 after inserting the rear portion 226 of the cam shaft 220 through the central opening 212 and prior to inserting the hub 210 and cam shaft 220 into the inside spindle 514.

In embodiments in which the pushbutton mechanism 590 is provided in the form of the pushbutton mechanism 300, block 620 may involve capturing the retainer plate 511 between the front side of the clip arms 314 and the rear shoulder 315 of the hub 310 such that axial movement of the hub 310 is restricted in both forward and rearward directions. For example, block 620 may involve deflecting the clip arms 314 radially inward to allow the clip arms 314 to pass beyond the inner periphery of the retainer plate 511, and subsequently allowing the clip arms 314 to flex outward to rotatably capture the retainer plate 511 between the front side of the clip arms 314 and the rear shoulder 315 of the hub 310.

In embodiments in which the pushbutton mechanism 590 is provided in the form of the pushbutton mechanism 400, block 620 may involve capturing the enlarged body portion 412 between the front side of the spring cage 518 and the rear side of the retainer plate 511 such that axial movement of the hub 410 is restricted in both forward and rearward directions.

The process 600 may further include block 630, which generally involves engaging the second component 592 with the inside spindle 514 such that the second component 592 is rotationally coupled with the inside spindle 514 and is axially movable relative to the inside spindle 514.

In embodiments in which the pushbutton mechanism 590 is provided in the form of the pushbutton mechanism 200, block 630 may involve engaging the slider 230 with the hub 210 such that the slider 230 is slidably engaged and rotationally coupled with the hub 210. For example, block 630 may involve inserting the splines 234 into the channels 214 such that the slider 230 is axially slidable relative to the hub 210 but cannot rotate relative to the hub 210. With the hub 210 rotationally coupled to the spindle 514 via engagement of the spline 216 and the slot 515, the slider 230 is rotationally coupled with the spindle 514 via the hub 210.

In embodiments in which the pushbutton mechanism 590 is provided in the form of the pushbutton mechanism 300, block 630 may involve inserting the slider 320 into the spindle 514 such that the spline 324 is received in the slot 515. The longitudinal length of the spline 324 is less than that of the slot 515 such that the slider 320 is operable to slide axially relative to the spindle 514.

In embodiments in which the pushbutton mechanism 590 is provided in the form of the pushbutton mechanism 400, block 630 may involve inserting the slider 420 into the spindle 514 such that the spline 424 is received in the slot 515. The longitudinal length of the spline 424 is less than that of the slot 515 such that the slider 420 is operable to slide axially relative to the spindle 514.

The process 600 may further include block 640, which generally involves engaging the first component 591 with the second component 592 via the cam interface 593 such that axial displacement of the second component 592 between the projected position and the depressed position is correlated with rotation of the first component 591 and the plunger 560 between the unlocking orientation and the locking orientation.

In embodiments in which the pushbutton mechanism 590 is provided in the form of the pushbutton mechanism 200, block 640 may involve engaging the cam shaft 220 with the slider 230 via the cam interface 250 by inserting the front end portion of the cam shaft 220 into the central opening 231 of the slider 230 such that the helical ridges 223 are received in the slots 233. With the helical ridges 223 received in the slots 233, the cam shaft ramps 224, 252 are operable to engage the followers 254 defined by the ramped edges of the slots 233 to correlate rotation of the cam shaft 220 with axial displacement of the slider 230.

In embodiments in which the pushbutton mechanism 590 is provided in the form of the pushbutton mechanism 300, block 640 may involve engaging the hub 310 with the slider 320 via the cam interface 340 by inserting the post 316 into the central opening 323 of the slider 320. With the post 316 extending into the central opening 323, the hub ramps 318, 342 are operable to engage the slider ramps 324, 344 to correlate rotation of the hub 310 with axial displacement of the slider 320.

In embodiments in which the pushbutton mechanism 590 is provided in the form of the pushbutton mechanism 400, block 640 may involve engaging the hub 410 with the slider 420 via the cam interface 340 by inserting the post 415 into the central opening 423 of the slider 420. With the post 415 extending into the central opening 323, the lugs 417, 418 defining the followers 444 are operable to engage the slider ramps 317, 318, defining the helical ramps 342 to correlate rotation of the hub 410 with axial displacement of the slider 420.

The process 600 may further include block 650, which generally involves manually driving the second component 592 from the projected position to the depressed position, thereby causing the cam interface 593 to rotate the first component 591 and the plunger 560 from the unlocking orientation to the locking orientation, thereby moving the lock 540 from the unlocked state to the locked state. In embodiments in which the pushbutton mechanism 590 is provided in the form of the pushbutton mechanism 200, causing the cam shaft 220 to rotate in a locking direction in response to depression of the pushbutton 240 and slider 230 as described above with reference to FIGS. 4-8. In embodiments in which the pushbutton mechanism 590 is provided in the form of the pushbutton mechanism 300, block 650 may involve causing the hub 310 to rotate in a locking direction in response to depression of the pushbutton 330 and slider 320 as described above with reference to FIGS. 9 and 10. In embodiments in which the pushbutton mechanism 590 is provided in the form of the pushbutton mechanism 400, block 650 may involve causing the hub 410 to rotate in a locking direction in response to depression of the pushbutton 430 and slider 420 as described above with reference to FIGS. 11 and 12.

The process 600 may further include block 660, which generally involves moving the lock 540 from the locked state to the unlocked state, thereby rotating the plunger 560 and the first component 591 from the locking orientation to the unlocking orientation, thereby causing the cam interface 593 to drive the second component 592 from the depressed position to the projected position. In embodiments in which the pushbutton mechanism 590 is provided in the form of the pushbutton mechanism 200, block 660 may involve causing the slider 230 and pushbutton 240 to move to the projected position in response to unlocking rotation of the cam shaft 220 as described above with reference to FIGS. 4-8. In embodiments in which the pushbutton mechanism 590 is provided in the form of the pushbutton mechanism 300, block 660 may involve causing the slider 320 and pushbutton 330 to move to the projected position in response to unlocking rotation of the hub 310 as described above with reference to FIGS. 9 and 10. In embodiments in which the pushbutton mechanism 590 is provided in the form of the pushbutton mechanism 400, block 660 may involve causing the slider 420 and pushbutton 430 to move to the projected position in response to unlocking rotation of the hub 410 as described above with reference to FIGS. 11 and 12.

Figure 15:
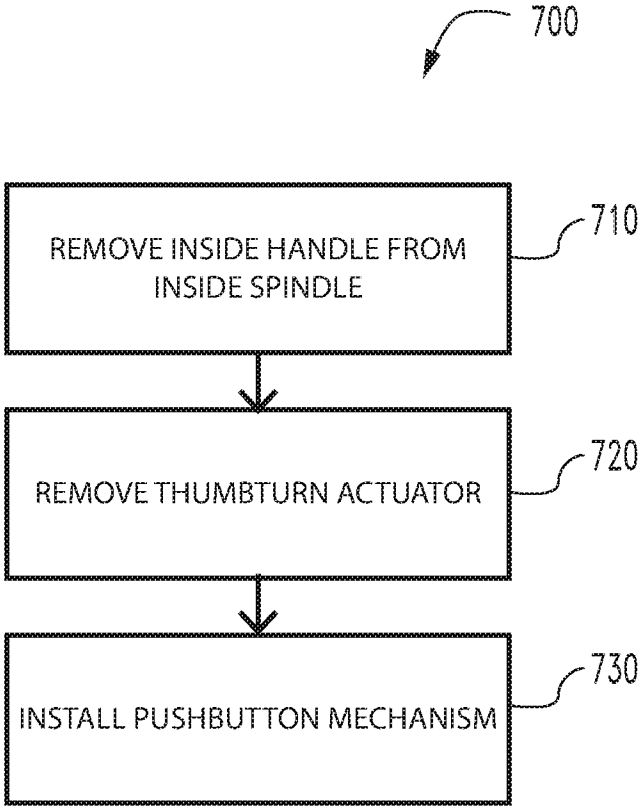

With additional reference to FIG. 15, illustrated therein is a process 700 according to certain embodiments. The process 700 generally involves retrofitting an existing lockset that includes an inside lock input device in the form of a turnpiece. For example, the lockset 500 may include a thumbturn actuator 519' rotationally coupled with the plunger 560, and the process 700 may involve retrofitting such an embodiment of the lockset 500 to include a pushbutton mechanism 590. The process 700 may include block 710, which includes removing the inside handle 516 from the inside spindle 514, thereby enabling removal of the thumbturn actuator 519' from a chamber 509 defined within the inside spindle 514. The process 700 includes block 720, which generally involves removing the thumbturn actuator 519' from the plunger 560, thereby opening the chamber 509 such that the pushbutton mechanism 590 can be installed into the chamber 509. The process 700 further includes block 730, which generally involves installing the pushbutton mechanism 590 to the lockset 500. For example, block 730 may include installing the pushbutton mechanism 590 according to the process 600.

Figure 16:
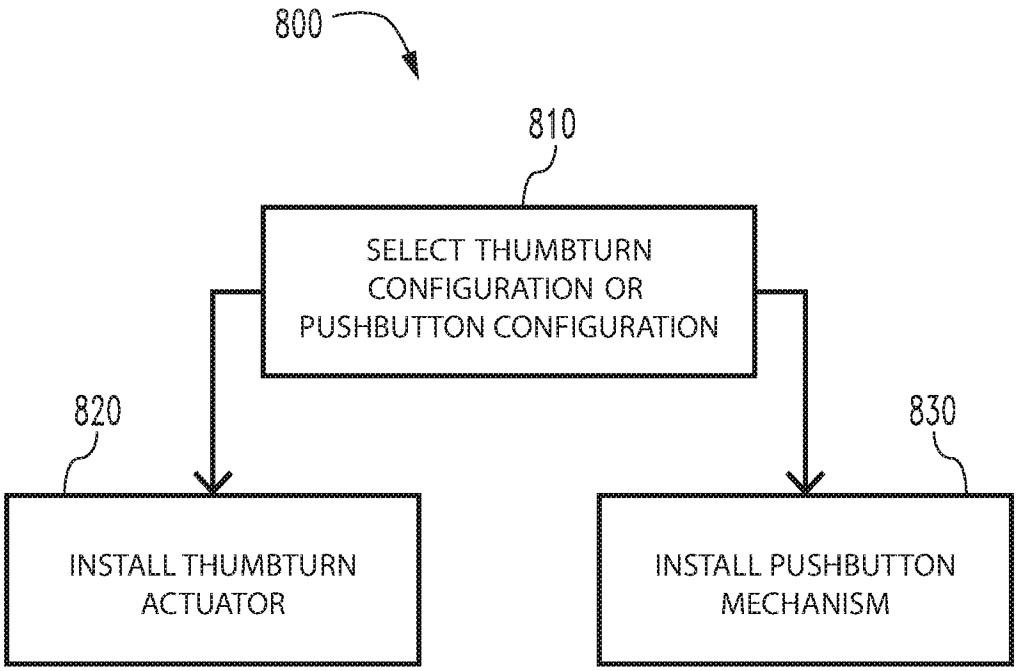

With additional reference to FIG. 16, illustrated therein is a process 800 according to certain embodiments. The process 800 generally involves assembling a lockset such as the lockset 500 either a thumbturn configuration or a pushbutton configuration. In each configuration, the lockset 500 may generally include an inside assembly 510 including an inside spindle 514, an outside assembly 520 including an outside spindle 524, a latchbolt mechanism 530, a center spindle 550 engaged with the latchbolt mechanism 530 such that rotation of the center spindle 550 actuates the latchbolt mechanism 530, a lock 540 selectively enabling the outside spindle 524 to rotate the center spindle 550, and a plunger 560 engaged with the lock 540 such that movement of the lock 540 between a locked state and an unlocked state is correlated with rotation of the plunger 560 between a locking orientation and an unlocking orientation. Upon completion of the process 800, the lockset 500 may further include an inside lock input device 519 operable to rotate the plunger 560 from the unlocking orientation to the locking orientation, and which moves from a locking state to an unlocking state in response to rotation of the plunger 560 from the locking orientation to the unlocking orientation.

The process 800 generally involves block 810, which involves selecting one of a thumbturn configuration or a pushbutton configuration for the lockset 500. In certain embodiments, the process 800 may involve selecting the thumbturn configuration. In such a case, the process 800 may proceed to block 820, which generally involves installing the thumbturn actuator 519' to the lockset 500 such that the thumbturn actuator 519' is rotationally coupled with the plunger 560. In other embodiments, the process 800 may involve selecting the pushbutton configuration. In such a case, the process 800 may proceed to block 830, which generally involves installing the pushbutton mechanism 590 to the lockset 500 such that the first component 591 is rotationally coupled with the plunger 560, the second component 592 is axially displaceable relative to the spindle 514, and the cam mechanism 593 correlates rotation of the first component 591 with axial displacement of the second component 592. For example, block 830 may include installing the pushbutton mechanism 590 according to the process 600.

As should be appreciated from the foregoing, the pushbutton mechanisms described herein may provide one or more advantages over prior pushbutton mechanisms. For example, the pushbutton mechanisms described herein correlate axial displacement of the pushbutton with rotation of the plunger. As a result, depression of the pushbutton can cause rotation of the plunger from the unlocking orientation to the locking orientation, and rotation of the plunger from the locking orientation to the unlocking orientation can drive the pushbutton to its projected position. Thus, unlock certain prior pushbutton mechanisms, the pushbutton mechanisms of the illustrated embodiments are capable of being used in combination with the same form of lock that is operable by a thumbturn.

The interchangeability of the pushbutton mechanisms with thumbturn mechanisms may itself provide one or more advantages. By way of illustration, the pushbutton mechanisms may be utilized to retrofit an existing thumbturn-configuration lockset to convert the existing lockset into a pushbutton-configuration lockset, for example as described with reference to FIG. 15. As another example, the interchangeability of the pushbutton mechanisms with thumbturn mechanisms may facilitate the creation of a configurable lockset in which the configuration of the lockset is selectable at the time of manufacture and/or installation, such as described with reference to FIG. 16.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A modular pushbutton mechanism configured for use with a lockset including a spindle and a plunger extending into the spindle, the modular pushbutton mechanism comprising:

a first component configured for rotational coupling with the plunger and for axial coupling with the spindle, wherein the first component is rotatable between a locking orientation and an unlocking orientation;

a second component configured for rotational coupling with the spindle and for axial movement relative to the first component and the spindle, wherein the second component is axially movable between a depressed position and a projected position; and a cam interface configured to correlate rotation of the first component with axial displacement of the second component, wherein the cam interface comprises a pair of helical ramps and a pair of followers with the helical ramps.

2. The modular pushbutton mechanism of claim 1, further comprising a hub configured for axial and rotational coupling with the inside spindle;

wherein the first component is rotatably mounted to the hub such that the hub restricts axial displacement of the first component relative to the hub; and wherein the second component is slidably mounted to the hub such that the hub restricts rotation of the second component relative to the hub.

3. The modular pushbutton mechanism of claim 1, wherein a first of the helical ramps is engaged with a first of the followers such that movement of the second component from the projected position to the depressed position causes a corresponding rotation of the first component from the unlocking orientation to the locking orientation; and wherein a second of the helical ramps is engaged with a second of the followers such that movement of the first component from the locking orientation to the unlocking orientation causes a corresponding axial displacement of the second component from the depressed position to the projected position.

4. The modular pushbutton mechanism of claim 3, wherein the second component comprises at least one helical ridge defining the pair of helical ramps; and wherein the first component comprises at least one slot defined by the pair of followers.

5. The modular pushbutton mechanism of claim 3, wherein one of the first component or the second component comprises the pair of helical ramps; and wherein the other of the first component or the second component comprises the followers.

6. The modular pushbutton mechanism of claim 5, wherein the second component comprises the pair of helical ramps; and wherein the first component comprises a second pair of helical ramps defining the pair of followers.

7. The modular pushbutton mechanism of claim 5, wherein the first component comprises the pair of helical ramps; and wherein the second component comprises a pair of projections defining the pair of follower.

8. The modular pushbutton mechanism of claim 1, wherein the first component comprises a cylindrical body portion configured for rotational mounting in the spindle, and a post extending from the cylindrical body portion and into engagement with the second component; and wherein the post partially defines the cam interface.

9. The modular pushbutton mechanism of claim 8, wherein the first component further comprises a pair of deflectable clip arms configured for rotational coupling with a retainer plate installed in the spindle.

10. The modular pushbutton mechanism of claim 1, further comprising a pushbutton mounted to the second component, wherein the first component extends into the pushbutton when the second component is in the depressed position.

11. A system including the pushbutton mechanism of claim 1, and further comprising the lockset;

wherein the first component is rotationally coupled with the plunger and is axially coupled with the spindle; and wherein the second component is rotationally coupled with the spindle is axially movable relative to the first component and the spindle.

12. A method of installing a modular pushbutton mechanism to a lockset including an inside spindle rotatable about an axis, a plunger extending into the inside spindle, and a lock engaged with the plunger such that rotation of the plunger between an unlocking orientation and a locking orientation is correlated with movement of the lock between an unlocked state and a locked state, the method comprising:

engaging a first component with the plunger such that the first component is rotationally coupled with the plunger for joint movement between the locking orientation and the unlocking orientation;

engaging the first component with the inside spindle such that the first component is axially coupled with the inside spindle;

engaging a second component with the inside spindle such that the second component is rotationally coupled with the inside spindle and is axially movable relative to the inside spindle; and engaging the first component with the second component via a cam interface such that axial displacement of the second component between a projected position and a depressed position is correlated with rotation of the first component and the plunger between the unlocking orientation and the locking orientation, wherein the cam interface comprises a pair of helical ramps and a pair of followers with the helical ramps.

13. The method of claim 12, wherein the method further comprises removing an existing turnpiece from the plunger, thereby exposing a chamber into which the first component and the second component are subsequently installed.

14. The method of claim 12, further comprising engaging a pushbutton with the first component such that the first component and the pushbutton are rotationally and axially coupled with one another.

15. The method of claim 12, further comprising:

manually driving the second component from the projected position to the depressed position, thereby causing the cam interface to rotate the first component and the plunger from the unlocking orientation to the locking orientation, thereby moving the lock from the unlocked state to the locked state; and moving the lock from the locked state to the unlocked state, thereby rotating the plunger and the first component from the locking orientation to the unlocking orientation, thereby causing the cam interface to drive the second component from the depressed position to the projected position.

16. The method of claim 12, further comprising mounting a hub to the inside spindle such that the hub is axially and rotationally coupled with the inside spindle;

wherein engaging the first component with the inside spindle comprises engaging the first component with the inside spindle via the hub such that the hub restricts axial movement of the first component relative to the inside spindle; and wherein engaging a second component with the inside spindle comprises engaging the second component with the inside spindle via the hub such that the hub rotationally and axially couples the first component with the inside spindle.

17. A lockset, comprising:

an inside housing;

an inside spindle rotatably mounted to the inside housing;

an outside housing;

an outside spindle rotatably mounted to the outside housing;

a latchbolt mechanism including a latchbolt having an extended position and a retracted position;

a center spindle engaged with the latchbolt mechanism such that rotation of the center spindle drives the latchbolt from the extended position to the retracted position, wherein the center spindle is coupled with the inside spindle;

a lock selectively coupling the outside spindle with the center spindle, the lock having an unlocked state in which the lock rotationally couples the outside spindle with the center spindle, the lock having a locked state in which the lock rotationally decouples the outside spindle from the center spindle;

a plunger engaged with the lock and extending into the inside spindle, the plunger rotatable between an unlocking orientation corresponding to the unlocked state and a locking orientation corresponding to the locked state; and a pushbutton mechanism mounted in the inside spindle, the pushbutton mechanism comprising:

a first component axially coupled with the inside spindle and rotationally coupled with the plunger for joint rotation between the unlocking orientation and the unlocking orientation;

a second component rotationally coupled with the inside spindle and mounted for axial movement relative to the first component and the inside spindle, wherein the second component is axially movable between a depressed position and a projected position; and a cam interface defined at least in part by the first component and the second component;

wherein the cam interface is configured to rotate the first component and the plunger from the unlocking orientation to the locking orientation in response to axial displacement of the second component from the projected position to the depressed position;

wherein the cam interface configured to axially drive the second component from the depressed position to the projected position in response to rotation of the first component and the plunger from the locking orientation to the unlocking orientation, and wherein the cam interface comprises a pair of helical ramps and a pair of followers with the helical ramps.

18. The lockset of claim 17, further comprising a retainer plate mounted in the inside spindle, wherein the first component is engaged with the retainer plate such that the retainer plate restricts axial movement of the first component.

19. The lockset of claim 18, wherein the first component comprises a pair of deflectable clip arms engaged with the retainer plate such that the first component is rotatably coupled with the retainer plate.

20. The lockset of claim 17, wherein the second component comprises a spline seated in a slot of the inside spindle such that the second component is rotationally coupled with the inside spindle and is axially slidable relative to the inside spindle.

21. The lockset of claim 17, wherein the pushbutton mechanism further comprises a hub rotationally and axially coupled with the inside spindle;

wherein the first component is rotatably mounted in the hub; and wherein the second component is slidably engaged and rotationally coupled with the hub.

22. The lockset of claim 17, wherein the cam interface comprises:

a first pair of helical ramps defined by the first component; and a second pair of helical ramps defined by the second component;

wherein the first pair of helical ramps is engaged with the second pair of helical ramps.

* * * * *